US005715874A

United States Patent [19]

Reynolds et al.

[11] Patent Number: 5,715,874

[45] Date of Patent: Feb. 10, 1998

[54] BEVERAGE PACKAGING METHOD AND APPARATUS

[75] Inventors: Andrew John Reynolds, Cambs; Michael John Newman, Hertfordshire; Timothy Michael Wood, Hertfordshire; John Poley, Hertfordshire, all of United Kingdom

[73] Assignee: Scottish & Newcastle PLC, Edinburgh, Scotland

[21] Appl. No.: 535,203

[22] PCT Filed: Mar. 31, 1994

[86] PCT No.: PCT/GB94/00696

§ 371 Date: Oct. 23, 1995

§ 102(e) Date: Oct. 23, 1995

[87] PCT Pub. No.: WO94/25368

PCT Pub. Date: Nov. 10, 1994

[30] Foreign Application Priority Data

Apr. 30, 1993 [GB] United Kingdom ..... 9309015

[51] Int. Cl.[6] ..... B65B 1/04

[52] U.S. Cl. ..... 141/2; 141/18; 141/82; 141/100; 141/63; 426/398; 53/432

[58] Field of Search ..... 141/2, 4, 5, 7, 141/8, 18, 46, 47, 48, 49, 64, 66, 9, 100, 63, 82; 53/432; 206/217, 219, 221; 222/190, 394, 399; 426/394, 397, 398, 477

[56] References Cited

U.S. PATENT DOCUMENTS 4,832,968 5/1989 Forage et al. ..... 426/398
5,517,804 5/1996 Lynch ..... 53/432

FOREIGN PATENT DOCUMENTS 0 227 213 7/1987 European Pat. Off. .
1 266 351 3/1972 United Kingdom .
2 218 079 11/1989 United Kingdom .

*Primary Examiner*—Henry J. Recla
*Assistant Examiner*—Steven O. Douglas
*Attorney, Agent, or Firm*—Lee, Mann, Smith, McWilliams, Sweeney & Ohlson

[57] ABSTRACT

Method and apparatus is described for removing oxygen from a can and frothy head inducing capsule of a lightweight two piece can beverage pack storing alcoholic beverage under gaseous pressure. The method involves evacuating the can and the capsule combination and purging with an inert gas such as Nitrogen and retaining the purged condition of the capsule and of the can by filling the can with water. Just before the can is to be filled the can is inverted to pour the water away and is washed in a conventional manner and re-inverted ready for filling. The method may be automated by marshalling cans on a conveyor and purging a large number of cans simultaneously in a batch first of all to the evacuation, then the purging step and then the water filling step. Two batch purging units may be provided and operated out of synchronism to provide a continuous supply of purged cans partly filled with water ready for feeding to the can washing and filling facility. Alternative apparatus involves injecting Nitrogen gas in liquid or gaseous from into the capsule before or after it is inserted into the can and plugging the hole made by the falling device so as to retain the gas charge within the capsule.

6 Claims, 5 Drawing Sheets

BEVERAGE PACKAGING METHOD AND APPARATUS

FIELD OF INVENTION

This invention concerns the packaging of beverages particularly but not exclusively beer in combination with devices within the packaging for generating a frothy head on the beer when the package is broken and the contents are poured prior to consumption. Such devices will be referred to as head inducers. The term beer can include any alcoholic drink such as beer, stout, ale, lager and the like having gas such as carbon dioxide and/or nitrogen dissolved therein.

By packaging is meant the filling of cans or like containers. A popular form of packaging is a so-called two part can formed from aluminium and comprising a cylindrical reservoir section which is closed at the base and open at the top and a closure section comprising a circular plate or lid which can be rim sealed to the periphery of the open end of the can to form a liquid and gas tight enclosure.

BACKGROUND TO THE INVENTION

It is known to fill the reservoir section of a two part can with beer having previously inserted into the can a head inducer (see UK Patent Specification No. 2218080A). It is also known from EP 0227213A2 to add a quantity of a liquified inert gas such as nitrogen which with increasing temperature begins to boil and change state into its gaseous form so displacing any air at the upper end of the can above the liquid and thereafter to add the closure section (normally a lid) to the can, and join the two parts together, so as to form a fluid tight seal, and to then subject the can to pasturisation in which the filled can is heated and then cooled in a controlled manner and thereafter to turn the can back onto its base and check the level of the contents before further processing the cans for storage and transportation, typically involving the packaging of the filled cans into boxes or groups using shrink wrapping techniques or the like (see Metal Box Ltd Guidance Notes for the Handling and Use of two piece lightweight cans (particularly Section 1.1.5 on page 2), and UK Patent Specification No. 2218080A.

The sealed can will be subjected to a relatively high internal pressure as a result of adding the liquified gas and particularly as a further consequence of heating the can during pasturisation. Consequently if the seal between lid and reservoir section is not fluid tight, fluid will leave the can through the faulty seal during pasturisation if not before. Since the lid and reservoir section can be individually checked before filling, the only essentially weak link is the rim seal.

Since the cans are easily damaged it was recommended by the can manufacturers in 1981 that filled and sealed cans should be upended as soon as possible after leaving the seamer and before pasteurization and this had the added advantage that any loss from the can would be beverge and not gas.

By upending the filled can before and during pasturisation, it will be the liquid content of the can will be driven out of any faulty seam under the elevated internal pressure. Any loss of liquid can be detected by means of a check on the level of the liquid remaining in the can after pasturisation. The step of upending filled cans for this purpose is well known in the canning industry and was adopted following the issue of the Guidance Notes for the handling and use of two piece lightweight cans (see Section 1.1.5) by Metal Box Ltd in the early 1980's.

It has been proposed in EP 227213A2 that the head inducer should be filled at least partly with an inert-gas under pressure, to retain the device at or near the bottom of the can, and to cause pressurised gas and/or beverage from within the device to leave it in the form of a fine jet when the can lid is broken. For this to happen the interior of the head inducer must communicate with the liquid within the can via a small orifice in the wall separating the contents of the inducer from the beverage in the can.

Since the head formation is essentially only created by the discharge of a gas jet at the pressures available in a can, it has always been desirable to maximise the volume of gas in the head inducer as described in UK 2218080A.

It has also been proposed to force inert gas into the inducer device either via the said orifice (see UK 2218080A) or via another "filling" orifice, see UK 1266351 and copending UK Application No. 9305728.9 now proceeding as a PCT Application filed on 18th Mar. 1994, from the pressurised gas in the headspace above the liquid in the can. The earlier technique of UK 2218080A took advantage of the upending of the can during prior to pasturisation, when the headspace transfers to the now upended base of the can where the head inducing device was situated, so that the latter is now in communication with the gas in the headspace instead of the liquid contents of the can via the said orifice. The later technique of UK 9305728.9 proposed that the head inducer communicate with the headspace when the can is in its normal position (ie standing on its base) via a chimney-like extension to the device.

In either event, the device must include an orifice by which fluid can pass into and out of the device and the present invention is directed to the use of such orifice containing head inducing devices in pressurised lightweight cans used for storing alcoholic beverages.

Now with many beverages, particulary alcoholic beverages, it is important that the sealed can contains substantially no oxidising agent such as oxygen. Since air contains oxygen, it is therefore necessary to exclude air from the interior of the can, before it is sealed. Whilst the can will be purged by the liquified inert gas added during and immediately after filling, any gas in the head inducer located at the bottom of the can (which becomes covered by the liquid during filling) will become trapped inside it as the can fills up with beverage.

It is an object of the present invention to ensure that any gas trapped in a head inducing device as aforesaid is substantially non-oxidising.

SUMMARY OF THE INVENTION

According to the aspect of the present invention a can filling method in which a head inducing device is inserted into a can before the can is filled with beverage and sealed, includes the step of filling the interior of the head inducing device with at least a non-oxidising fluid.

The non-oxidising fluid may be liquid or gas and preferably is an inert gas such as that which is added in liquified form to the can at the final filling step.

Where the fluid is such a gas, it may be added to the device in liquified or gaseous form.

The head inducing device may be inserted into a can and filled with non-oxidising fluid whilst in the can or may be filled with a fluid before inserting in the can.

Whether in or out of the can, the filled device may be stored for example in a low temperature environment containing liquified inert gas similar to that within the device or in the inert gas at a temperature well below normal room temperatures but above the temperature at which the gas will liquefy and the device is removed from the low temperature environment and quickly inserted into a can just before filling the latter with the beverage (or if already in the can) the can containing the device can be moved from the low temperature environment and positioned rapidly below a beverage filling head in a beverage filling station.

In either event, since the orifice in the wall of the head inducing device is very small, there will be very little net loss of gas or liquid gas from the device during such transfer.

By ensuring that the device contains inert gas at a lower temperature the ambient air temperature and the beverage temperature, a positive pressure will exist within the device at all times prior to and during filling. There will therefore be no tendency for any air to ingress and there will be little tendency for any of the beverage to enter the device as the can is filled.

Apparatus for performing the method of the invention includes means for filling the interior of the head inducing device with a non-oxidising fluid either prior to or during the filling of a can (containing the device), with the liquid to be stored in the can.

In a particularly preferred method the head inducing device may be filled with non-oxidising fluid such as an inert gas such as nitrogen and if it is not in the can, it is immediately inserted into an empty can thereafter, and the device is then covered by a non-oxidising liquid such as water by filling the can to an apropriate depth with the liquid.

By covering the head inducing device the gaseous contents are trapped and a small positive pressure of the gaseous material may even be maintained in the device depending on the head of liquid above the device within the can.

The liquid surrounding the device not only prevents the loss of the gaseous contents from the device but also prevents ingress of air or other contaminants into the device.

The can and device filled With the non-oxidising material can be stored for a considerable period of time (if required) in this way, but however long it is stored, just before the can is to be filled with beverage, the can is emptied of the liquid covering the device to enable the filling procedure to be carried out in manner known per se, by locating the now empty can immediately below a filling head and discharging beverage into the can.

Where water is employed as the covering liquid for storage, preferably distilled water is employed or at least water having little or no dissolved oxygen therein.

Apparatus for performing the preferred method comprises:

1. means for filling the interior of a head inducing device with a non-oxidising fluid,
2. means for inserting the orifice containing device into a can either before or after it has been filled with the non-oxidising fluid,
3. means for filling the can with a non-oxidising liquid to at least cover any orifice in the head inducing device in the can and thereby trap non-oxidising fluid within the said device, and
4. means for effecting removal of the liquid just before the can is to be filled with beverage.

The means for filling the head inducing device with non-oxidising fluid may comprise a chamber within which the device can be sealed and which is selectively connectable to a vacuum pump to remove all the air from the chamber and the device therein, and thereafter to a source of non-oxidising fluid such as an inert gas, for filling the evacuated interior of the device.

Evacuation and filling of the device immediately prior to the filling of the can with beverage has already been proposed in the literature. Since can filling lines tend to operate at high throughput speeds this involves high speed evacuation and high speed replenishment in order to keep up with the filling line. Incomplete replacement of the air within the device has been experienced when operating at such speeds and various techniques have been proposed to overcome this problem such as performing a sequence of evacuations and replenishments immediately prior to filling the can—see for example 2218080A.

The present invention side steps the problems associated with high speed can filling lines by allowing the devices to be filled with non-oxidising fluid "off line" if desired, possibly on a batch rather than a continuous basis. Once the devices have been submerged under the non-oxidising liquid (typically water), the cans and the devices can be stored pending their use on a filling line, whether it be seconds, minutes, hours or even days later.

If however it is desired that the devices are to be filled "on stream", non-oxidising fluid (eg inert gas) may be pumped in liquid or gaseous form into the head inducing device prior to filling the can (whether the device is either in or out of the can), and if not in the can, means is provided for inserting the inert fluid filled device into the can before filling commences.

In its most simple form the gas filling technique may be achieved by subjecting the device to a vacuum and then to a gaseous environment containing the gas which is to fill the device—whether in the can or not.

According to another aspect of the present invention, there is provided a canning line adapted to handle lightweight cans for filling with beverage and comprising a main can conveyor path leading to a can upending station, a can washing facility for washing the cans in their upended condition, a can inverter and a can filling and seaming facility, characterised in that:

the line includes a bypass to the main path containing a purging station and means for selectively directing cans which must be purged before being filled into the bypass and for receiving the purged cans back onto the main path, ahead of the filler and seamer.

Such a line is therefore adapted to handle cans which have been filled with a head inducing device as well as cans which have not been so fitted.

The purging station may take the form of apparatus for injecting inert gas in liquid or gaseous form into the device and thereafter covering the filled device with a blanket of liquid which retains the gas in the device and if fitted to a container keeps air out of the container in which the device is fitted.

The injection of inert gas into the device may be achieved most simply by subjecting the device (and the interior of the container if it is fitted into a container) to a vacuum and thereafter supplanting the vacuum with an inert gas, which enters the head inducing device through the orifice and blankets the device and the interior of the can, until the latter is filled (or partly filled) with a non oxygen containing liquid, to prevent air from reaching the purged device and lower region of the can.

Where the main path includes a can inverting and washing facility prior to the filler, the purged cans containing liquid will be emptied by the can inversion before the washing step.

Where the main path does not include a can inverting and washing facility ahead of the filler, the bypass preferably includes at least the inversion step just prior to the cans rejoining the main path and preferably the cans proceed straight from there to a final can twist just prior to the can filler so that the cans are presented right way up to the can filler facility.

Alternatively a rigid tubular device having a sharpened end for penetrating the wall of the head inducing device, in the form of a hypodermic needle, may be used for introducing gas into the interior of the head inducing device whether the latter is within the can or not.

The head inducing device may be formed from a material which self-seals any opening formed by the penetration of a tube or needle after the latter has been withdrawn.

Alternatively the filling needle may be formed with a separable self-sealing section which is retained in the wall of the head inducing device so that after non-oxidising fluid has been pumped into the device, the section of the needle protruding through the wall of the device is separated from the remainder of the needle and the self-sealing section is left in place. The upper end of the protruding needle may be pinched or otherwise closed off or may incorporate a one-way valve so as to prevent the egress of pressurised fluid therethrough.

A self-sealing section may comprise a frusto conical enlargement around the needle, the smaller diameter of the frusto conical section corresponding to the external diameter of the needle and being situated towards the sharpened end thereof so that the needle can be pushed through the wall of the device, the frusto conical section stretching the wall material of the device to accommodate the external diameter of the enlargement. By selecting an appropriate material for the wall of the device, so as to possess a natural resilience, the latter will close around the needle after the frusto conical section has passed through, and the shoulder presented to the internal surface of the device by the other end of the frusto conical section will serve to seal the opening made by the penetration and will not only prevent the needle from being withdrawn (thereby simplifying separation of the penetrating section of the needle from the remaining part), but will also serve to prevent the needle from being pushed out by positive pressure from within the device.

The shoulder formed by the frusto conical protrusion may to advantage itself taper albeit at a much steeper angle than the conical surface on the leading end of the protrusion, so as to assist in forming a plug seal.

Where the needle is to remain in place, means is needed for severing the needle material, or separating the needle from the inserting mechanism and where the needle is to be closed off, the severing or separating means (or a further means) serves to pinch or otherwise close off the needle.

The needle may for example be formed from steel (preferably stainless steel) or aluminium or a plastics material, in which latter event the sealing may be effected by a seam welding technique whilst the open end of the "needle" is squeezed together.

A rigid plastics material need not be employed for the part which is to remain attached to the wall of the device if a hollow rigid needle-like member is slid internally into a non-rigid sleeve of plastics material having a frusto conical protrusion in its outer surface, and the needle is slid rearwardly out of the sleeve after filling the device, leaving the sleeve in place ready to be sealed as by heat sealing as aforementioned.

A preferred arrangement comprises a two part plugging device comprising an assembly of a rigid member having an enlarged leading end (head) and carrying a resiliently deformable plastics sleeve behind the enlarged head.

By pushing the assembly though a small hole in a relatively rigid plastics material wall of the device, and then withdrawing the rigid member, the enlarged head thereof will enlarge the sleeve to fill and seal the hole. If the enlarged head is joined to the remainder of the rigid member by a frangible region, the jamming of the enlarged head will result in the latter breaking away from the remainder of the rigid member, so leaving the head jammed in the sleeve within the wall of the device.

Further refinements may be employed, such as a double headed plug, having two enlargements, which is positioned so as to leave the two enlarged regions on opposite sides of the opening in the wall of the device, thereby sealing the opening against ingress as well as egress of fluid.

Where a double headed plugging device is employed, the previously mentioned resiliently removable plastics sleeve may be omitted, if the resilience of the wall and plug material is sufficient to form a seal when the two heads of the plug are located on opposite sides of the opening in the wall of the head inducing device.

The invention will now be described, by way of example, with reference to the accompanying drawings, in which.

DETAILED DESCRIPTION OF THE DRAWINGS

Figure 1:
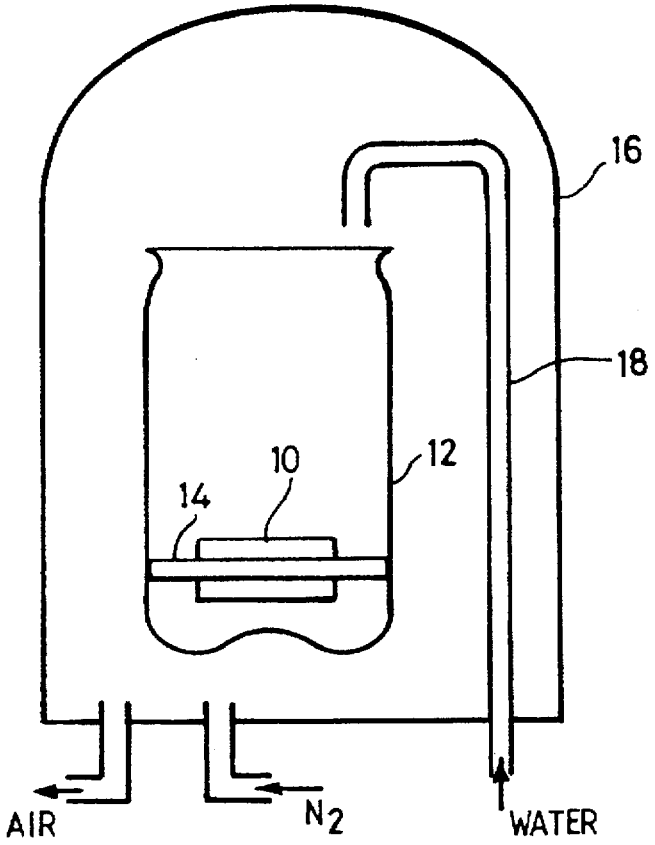
FIG. 1 shows a can with head inducer fitted prior to filling with beverage in an evacuation chamber.

In FIG. 1 a head inducing device 10 having a very small orifice (not shown) is shown secured in place in a can 12 by a bounding ring 14. The upper end of the can is open. The can is shown located within a closed chamber 16 attached to a vacuum pump (not shown) by which the gaseous contents of the device 10, can 12 and chamber 16 can be removed and replaced with an inert gas, by flooding the chamber, after evacuation, with the inert gas, preferably at a pressure just above atmospheric, so as to create a slight positive pressure in the device 10.

Figure 2:
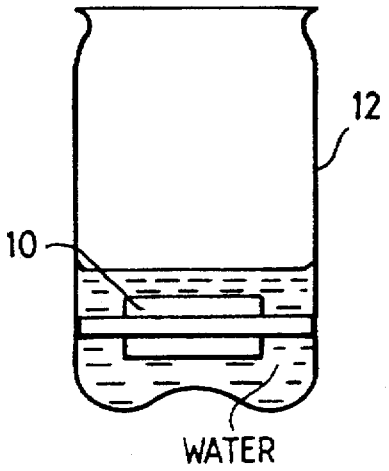
FIG. 2 shows the head inducer after it has been filled with an inert gas covered by water in the can for storage prior to filling the can with beverage.

Whilst still within the chamber 16 (or immediately after removal therefrom) the can is filled with water from a pipe 18, so that the device 10 is completely submerged as shown in FIG. 2. Where (as is preferred) the orifice (not shown) is in the underside of the device 10, the inert gas is thereby trapped within the device 10 by the water which forms a liquid seal.

The can and device can therefore be stored in this way without any risk of air entering the device 10, until the can is to be filled with beverage at which stage the water is removed for example by pouring away and the can is filled in manner known per se, preferably with a quantity of liquid nitrogen added just before the can lid is sealed to the upper end thereof (all in manner known per se).

Figure 3:
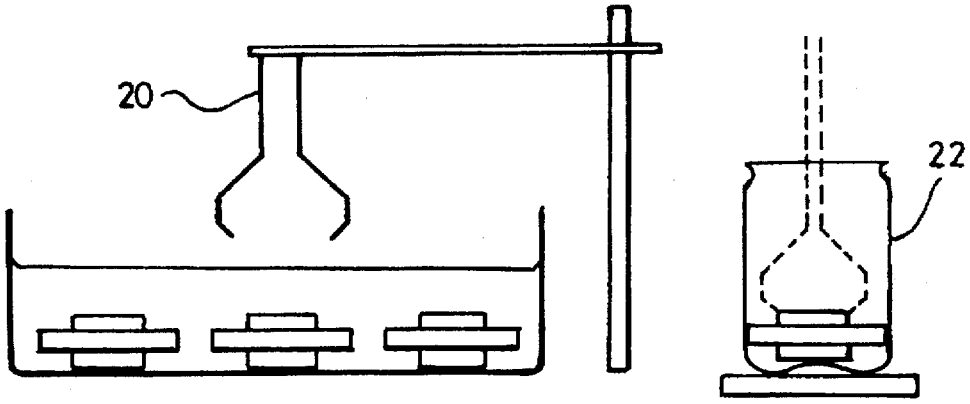
FIG. 3 shows head inducers within a low temperature bath of liquid nitrogen and means for removing them one at a time, full of liquid nitrogen for fitting into empty cans just before filling with beverage.
Figure 4:
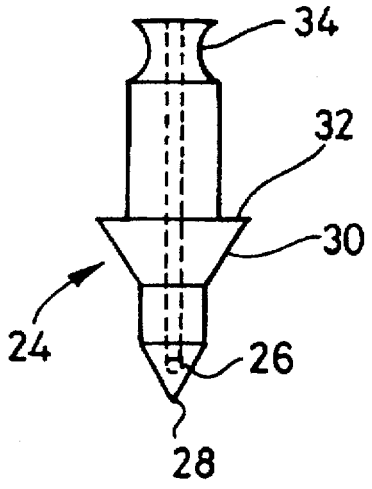
FIG. 4 shows one form of penetrating and filling needle for direct filling the device with nitrogen.

FIG. 3 shows an alternative arrangement in which the device 10 is filled with liquid and gaseous nitrogen and stored within a bath of liquid nitrogen and removed therefrom by a lifting arm 20 just before it is to be put into an awaiting can 22. After fitting within the can, the latter is filled with beverage and the lid added in manner known per se and since the device 10 is at least partly filled with liquid nitrogen, it may not be necessary to include nitrogen dosing prior to the cap being added to the can.

If instead the device 10 is fitted into the can prior to the beverage filling stage, the device can be purged of air and oxygen by piercing the upper wall by a hollow needle 24 which communicates through an opening 26 with the pointed lower end 28 and allows nitrogen to be pumped through the needle into the device 10 where the needle has punctured the wall thereof.

A frusto conical enlargement 30 (shown to an exaggerated scale) allows the needle to pass through the wall in one direction but prevents the reverse movement of the needle. The shoulder 32 seals against the interior of the wall and prevents loss of nitrogen. The needle device 24 is adapted to remain in the device 10 and a frangible section is shown at 34 which breaks as the needle is pulled upwards.

Figure 5:
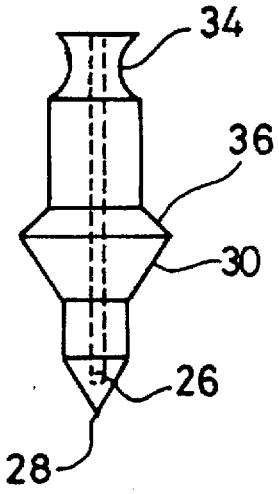
FIG. 5 shows another form of needle.

A preferred form of enlargement is shown at 36 in FIG. 5 where the upper shoulder 32 is also formed as a frusto conical surface to assist in plugging the hole formed by penetration of the needle. Again the needle must remain in place.

Although not shown, the upper end of the needle protruding from the device 10 is pinched, plugged or otherwise sealed to prevent ingress and egress of gas. Alternatively (although not shown) the passage between the section 34 and the opening 26 may include a one-way valve to prevent the egress of nitrogen from the device.

Figure 6:
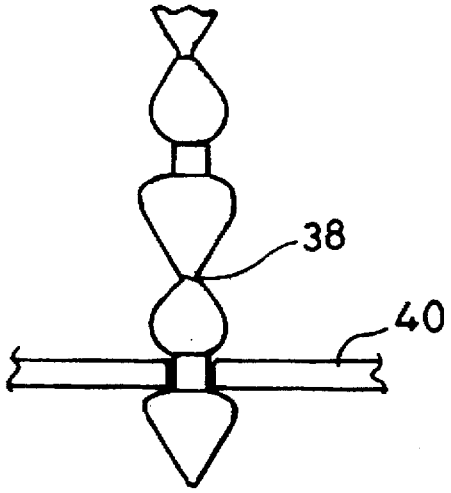
FIG. 6 shows a device for closing a hole formed by a filling needle.

FIG. 6 shows a line of double-headed devices which can be punched downwardly but if pulled upwardly will fracture at alternate joints such as 38. If the lower one of the lowest pair of heads is pushed through the hole left by a filling needle of the device 10, the lower head will protrude through the hole to the position as shown in FIG. 6 and the next head will lie above the hole. An upward pull on the line of heads immediately above the junction 38 will cause the lower pair to become severed at the frangible point 38 leaving the lowest pair heads trapped one on either side of the hole in the wall 40. The two heads serve to seal the hole against ingress and egress of gas.

An arrangement such as shown in FIG. 6 is particularly applicable where the material of the wall 40 is resiliently deformable and the material of the double headed sealing device is less resilient and almost rigid.

Figure 7:
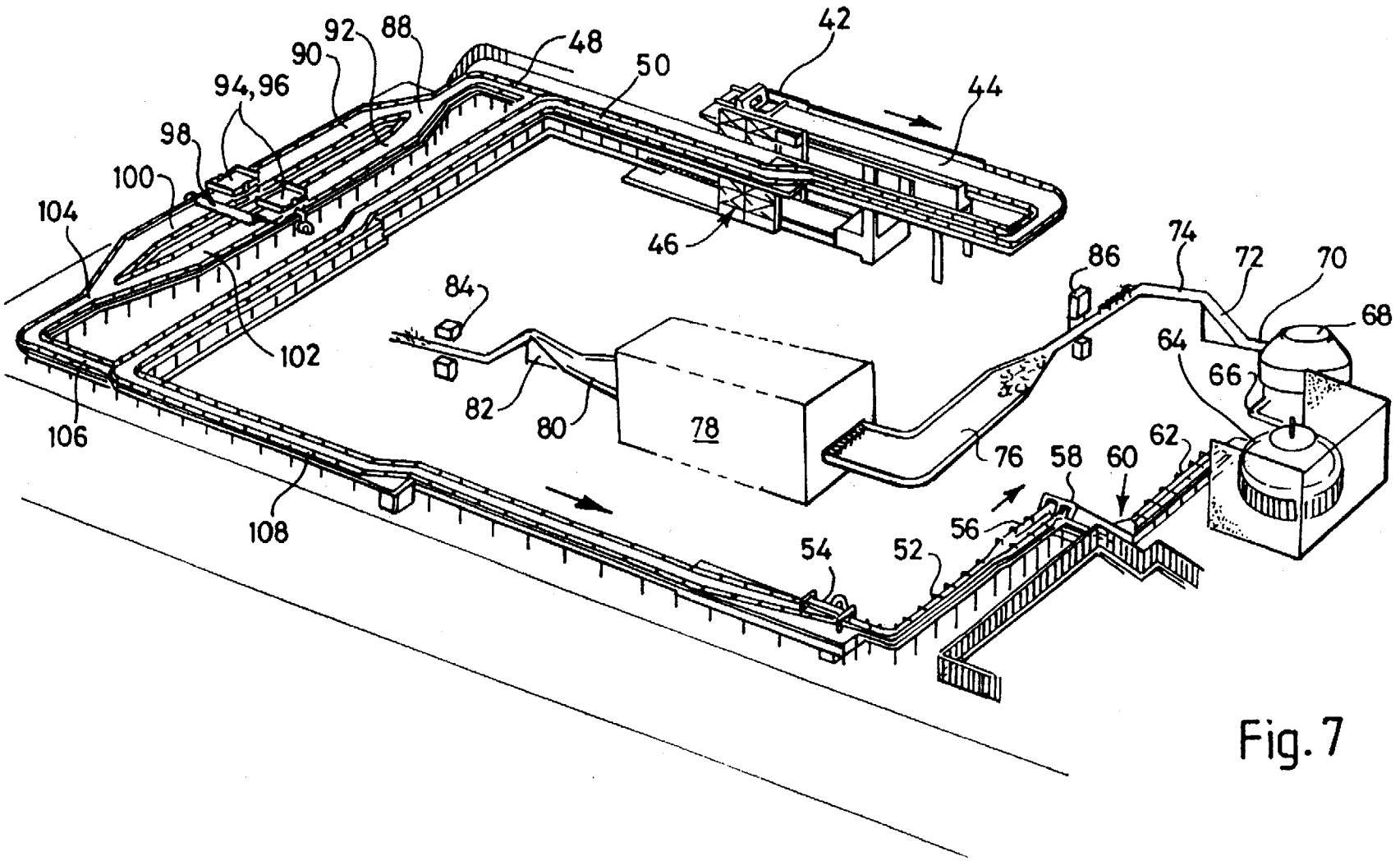
FIG. 7 illustrates a canning line capable of handling lightweight cans which may or may not have fitted therein head inducing devices.

FIG. 7 illustrates a canning line to which lightweight cans are supplied from pallets. The cans are removed from the pallets by a de-palletiser 42 and arranged on a conveyor 44 from which they are conveyed to a diverting station generally designated 46. Cans which contain head inducing devices proceed from the diverting station 46 onto a bypass conveyor 48 whilst cans which do not contain head inducing devices carry on along the main conveyor path 50.

As shown the bypass conveyor system 48 is essentially at the same level as the main conveyor system but it is to be understood that to reduce the footprint of the conveyor system, the bypass may be elevated relative to the main conveyor and may be located on a mezzanine floor within a canning plant over the existing conveyor.

Over most of its length, the main conveyor 50 conveys the cans 4 or 8 or 12 abreast but as the conveyor approaches the filler, so the width of the conveyor is reduced and the linear speed is increased. At the end the cans proceed along a final conveyor path 52 in single line at very high speed (typically at the rate of 1000 a minute past any one point) and are inverted in a first twister 54 so that they are upside down as they are presented to a washing facility 56. Thereafter they progress through a draining and drying facility 58 and through a second twist 60 so that the cans proceeding along the final section 62 to a filler 64 are the correct way up and are ready to be presented to the filler at the correct frequency to allow the rotating filler to take each can in turn and fill it as it rotates around the filling station. Thereafter the filled cans are lidded and seamed and the filled cans pass on an outfeed conveyor 66 to a seamer 68 from where the sealed cans leave on conveyor 70 where they pass straight to a can twister 72 before progressing along conveyor 74 to a marshalling region 76 where the cans are once again arranged many cans abreast so as to slow down the rate of forward movement before the cans progress into a pasturiser 78 where they will normally dwell for a period of 20 minutes or so. The leave on an outfeed conveyor 80 which feeds a collator 82 which arranges the cans in single file before they pass through a level detector 84 which determines whether or not any of the cans have leaked and marks any such cans for rejection further down the line.

If desired an earlier level detector 86 can be fitted to the line to investigate the fill level of cans leaving the seamer and before pasturisation. The purpose of this level detector is to determine whether or not any of the cans are overfilled or grossly underfilled so that these can be rejected before they proceed to the pasturiser. This is particularly important in the case of overfilled cans where the excess liquid in the can and therefore reduced headspace for gas, can result in an unacceptably high pressure being developed within the can during the pasturisation process.

In order to accommodate cans which have been fitted with a head inducing device, typically a plastics injection moulded capsule located and secured at the base of the can, the bypass conveyor system 48 is provided.

Cans containing such devices are unloaded onto the conveyor 44 and proceed to the conveyor 48 instead of the conveyor 50 at the diverter 46. A diverter 88 splits the flow of cans into two lines one along conveyor 90 and the other along conveyor 92 so that the purging to be performed oh the cans and the head inducing devices therein can be carried out more easily.

Although the flow of cans on conveyor 48 has been shown as being diverted into two streams 90 and 92, it is to be understood that the flow of cans can be divided into any number of lines depending on the number and capacity of the purgers.

The two purging stations shown at 94 and 96, include an evacuation facility in which can and capsules are evacuated to a low vacuum level for a given period of time. Thereafter a Nitrogen from a gas supply is supplied to the evacuated cans and capsules to fill them with Nitrogen gas.

Thereafter the purged units proceed under a water spray shown diagrammatically at 98 so that the cans are filled to a desired level with de-oxygenated water at least to a level sufficient to cover any orifice in the capsule and preferably a depth sufficient to more than completely cover the whole of the capsule.

From there the cans containing the capsule and the water proceed along the two combining conveyor paths 100 and 102 to the combining stage 104 where the conveyor speed accelerates to accommodate the large number of cans abreast on the two paths 100 and 102 so that the cans moving along the conveyor section 106 are ready to progress onto the similar sized conveyor 108 of the main conveyor.

It is not the intention that the bypass line be used simultaneously with the main conveyor path 50. Either one or the other is used at any one time. However it will be seen that when designed in, this way the canning line can accommodate cans which do not need purging before filling as well as cans which do need purging before filling, by simply altering the path through the diverter 46, so that cans to be purged pass around the bypass 48 etc, as opposed to passing around the conveyor path 50. A similar adjustment is needed where the conveyors 106 and 108 merge, to allow cans leaving the bypass to rejoin the main path.

Figure 8:
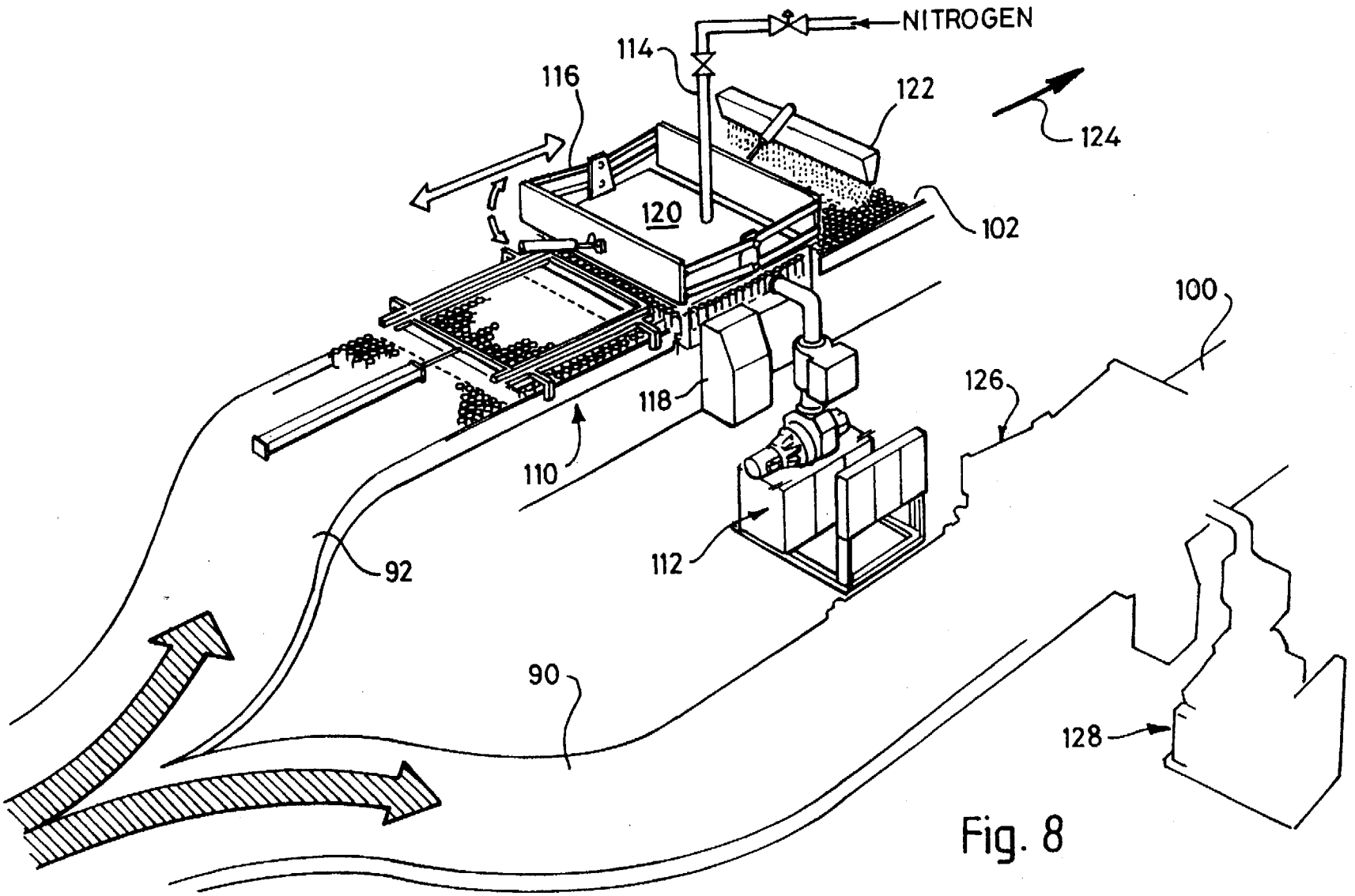
FIG. 8 illustrates part of the line of FIG. 7 in more detail.

FIG. 8 shows in more detail the purging and water spray.

The diverging conveyors 90 and 92 of FIG. 7 are shown feeding the two similar stations but the detail of the left hand one only is shown in FIG. 8.

A can grouping mechanism is provided at 110 so that the purger can be loaded with the same number of cans on each occasion. In this way the cans are handled in batches but because of the large number of cans involved and the streaming of the cans into two lines 90 and 92, the net effect is that provided the dwell time for each batch in the purger is relatively small, a substantially continuous flow of purged cans can be delivered at the outlet of the two lines at 104 in FIG. 7.

This is particularly so if the two purging units are operated sequentially so that whilst one is purging, the other is delivering purged cans.

The purging unit itself comprises a station in which a large number of collated cans can be subjected to first of all a high vacuum from a vacuum pump shown at 112 and thereafter are filled with Nitrogen under pressure from line 114. To this end a mechanism 116 is provided for raising and lowering a manifold over the can station, the manifold being designed to cooperate with the upper end of each of the array of cans so as to first of all evacuate and then pressurise with Nitrogen each of the cans in the array simultaneously.

A control unit 118 enables operation of the purger to be controlled.

Afer Nitrogen filling, the manifold 120 is lifted by the mechanism 116 enabling the purged cans to be moved rapidly below a water spray 122 which is operated in synchronism with the purger so that water is only sprayed onto the cans as a fresh batch of purged cans is delivered thereto.

The rate of progress in the direction of the arrow 124 and the rate of flow of the water from the water spray 122 is adjusted so that the cans are each supplied with a substantially constant volume of water which is calculated to be sufficient to more than cover the head inducing device (not shown) located at the bottom of each of the cans. Typically the volume of water is such as to fill the cans to between one third and half full of water.

Although not shown, apparatus is provided for de-oxygenating and de-aerating the water supplied to the water spray. Distilled water may for example be used.

The can array leaving the waterbath 122 is reduced in width as it proceeds along the conveyors 100 and 102 respectively and in this way the high speed throughput of cans along line 106 and subsequently line 108 is achieved.

The second purging unit generally designated 126 and vacuum pump 128 are shown merely in outline in FIG. 8.

Figure 9:
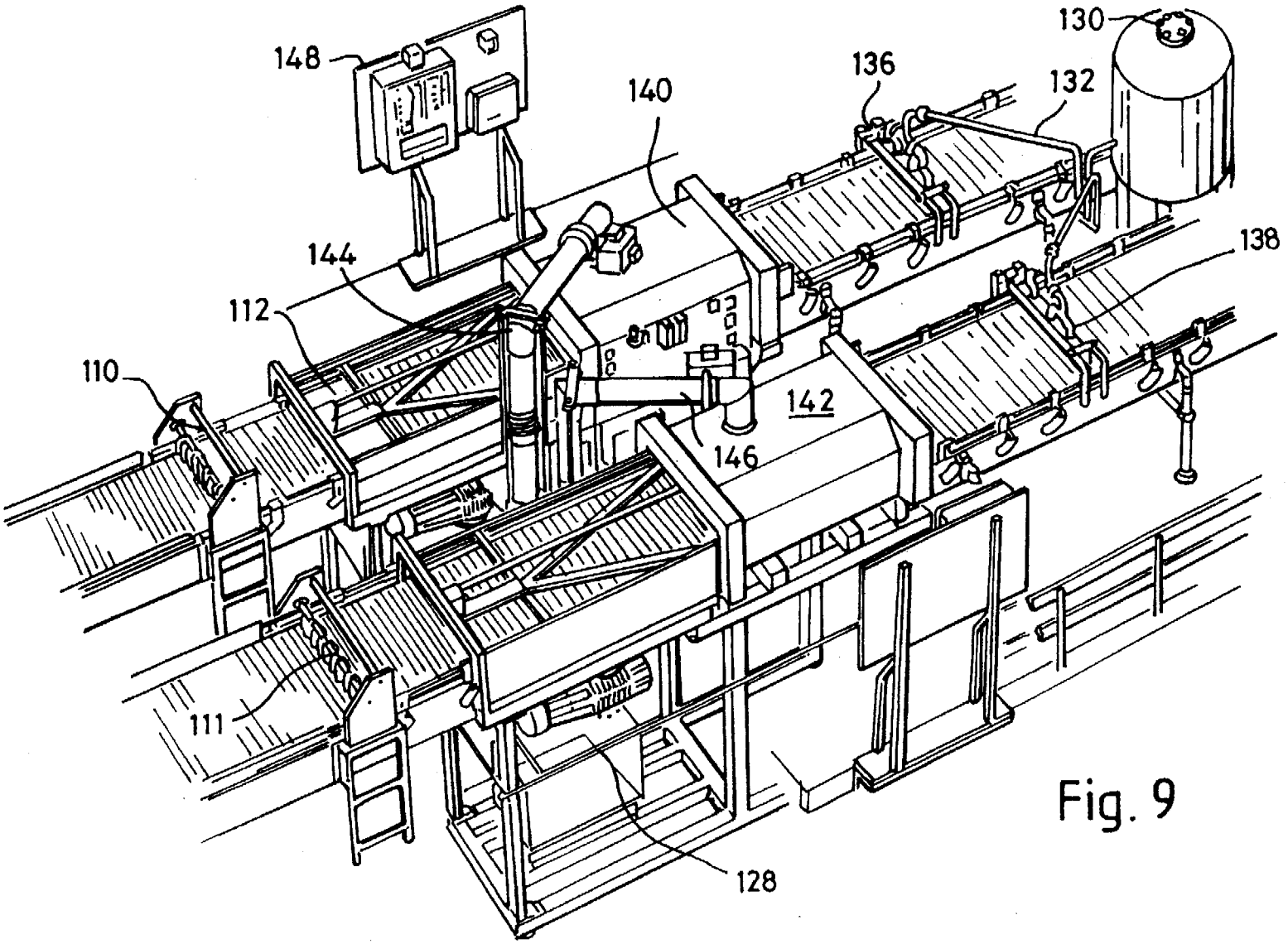
FIG. 9 illustrates in more detail still the purging section of FIG. 7.

FIG. 9 shows the two purging units in more detail. This includes the water holding tank 130 and feedpipes 132 and 134 feeding the water manifold 136 and 138 respectively.

The vacuum purging cabinets are shown at 140 and 142 respectively and the vacuum pipework at 144 and 146 respectively. The vacuum pump 128 and for the right hand unit and the vacuum pump 112 for the left hand unit previously shown in FIG. 8, can also be seen in FIG. 9 as can the can collating mechanisms and grouping mechanisms generally designated 110 and 111 in FIG. 9.

The control panel of FIG. 8 is now shown elevated at 148 instead of at 118.

Water flow to the manifolds 136 and 138 is controlled from the control panel and is synchronised to occur at the appropriate time and for the appropriate duration in each of the lines depending on the operation of the purging cabinet associated with the line. Thus the water is inhibited during the purging operation and is only caused to flow from the manifold into the cans as purged cans move therebelow.

The can grouping devices operate so as to assemble randomly arriving cans into line abreast across the conveyor and a barrier at the entrance to the purging cabinets causes the line abreast array to assemble into a complete filled in array of cans ready to be progressed into the purging cabinet as purged cans are released therefrom.

The infeed and outfeed conveyor to the purging cabinets operate in synchronism and conventional mechanical handling techniques are employed to ensure that the cans are marshalled correctly and progress smoothly and accurately into and out of the purging chamber.

We claim:

1. A can filling method in which prior to filling the can with beverage and sealing the can, a hollow capsule device is inserted into the can, the wall of the device including a small orifice through which gas can escape when the can is opened to induce a head on the beverage, and the device interior is filled with a non-oxygen containing gas characterised by the steps of:

(1) at least partially filling the can with a non-oxygen containing liquid so that the gas filled device is submerged below the liquid thereby trapping the gas therein, and (2) emptying the liquid from the can prior to the step of filling the can with the beverage.

2. A method as set forth in claim 1, wherein the non-oxygen containing gas is an inert gas similar to that which is added in liquified form to the can just prior to the sealing of the can.

3. A method as set forth in claim 1, wherein the head inducing capsule device is inserted into the can and filled with the non-oxygen containing gas after being fixed in the can.

4. A method as set forth in claim 1, wherein the non-oxygen containing liquid is distilled water which is employed to cover the capsule device in the can.

5. Apparatus for performing the method of claim 1, comprising:

(1) means for inserting the orifice containing capsule device into a can, (2) means for evacuating the device and the can, (3) means for filling the evacuated interior of the device and the can with a non-oxygen containing gas, (4) means for filling the can with a non-oxygen containing liquid to at least cover the orifice in the capsule device in the can, thereby to trap the non-oxygen containing gas within the device, and (5) means for effecting removal of the liquid from the can just before the can is to be filled with beverage.

6. A can filling method in which a head inducing capsule device is inserted into the can before the can is filled with beverage and sealed, each capsule including a small orifice in the wall thereof through which gas can escape when the can is opened to produce the head on the beverage, which method includes the step of filling the interior of the head inducing capsule device with at least a non-oxygen containing liquified inert gas, and in which after filling it with gas, and before filling the can with beverage, the gas filled device is stored in a low temperature environment in a liquified inert gas similar to that introduced into the capsule.

* * * * *